US009477180B2

(12) United States Patent
Fukuta et al.

(10) Patent No.: US 9,477,180 B2
(45) Date of Patent: Oct. 25, 2016

(54) DEVELOPING DEVICE INCLUDING HOUSING HAVING FIRST FRAME THAT SUPPORTS AGITATION MEMBER AND SECOND FRAME JOINTED TO FIRST FRAME AND CONFIGURED TO ACCOMMODATE DEVELOPER

(71) Applicant: Brother Kogyo Kabushiki Kaisha, Nagoya-shi, Aichi-ken (JP)

(72) Inventors: Hiroya Fukuta, Nagoya (JP); Fan Xu, Nagoya (JP); Keita Shimizu, Tsushima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/590,473

(22) Filed: Jan. 6, 2015

(65) Prior Publication Data

US 2015/0192881 A1 Jul. 9, 2015

(30) Foreign Application Priority Data

Jan. 6, 2014 (JP) ..... 2014-000606

(51) Int. Cl.
*G03G 15/08* (2006.01)

(52) U.S. Cl.
CPC ..... *G03G 15/0889* (2013.01)

(58) Field of Classification Search
CPC ..... G03G 15/0889
USPC ..... 399/254, 263
See application file for complete search history.

(56) References Cited

U.S. PATENT DOCUMENTS

| | | | | |
|---|---|---|---|---|
| 5,287,151 | A * | 2/1994 | Sugiyama | 399/258 |
| 6,421,517 | B1 * | 7/2002 | Nishino et al. | 399/254 |
| 6,456,810 | B1 * | 9/2002 | Deguchi et al. | 399/254 |
| 6,501,933 | B2 * | 12/2002 | Ishii | 399/254 |
| 7,941,073 | B2 * | 5/2011 | Takagi et al. | 399/120 |
| 8,781,377 | B2 | 7/2014 | Shiraki et al. | |
| 2008/0310881 | A1 * | 12/2008 | Sato | 399/111 |
| 2011/0158710 | A1 | 6/2011 | Shiraki et al. | |
| 2014/0356034 | A1 | 12/2014 | Shiraki et al. | |

FOREIGN PATENT DOCUMENTS

JP 2011-133755 A 7/2011

* cited by examiner

*Primary Examiner* — David Gray
*Assistant Examiner* — Trevor J Bervik
(74) *Attorney, Agent, or Firm* — Banner & Witcoff, Ltd.

(57) ABSTRACT

A developing device includes: an agitation member including an agitation film; and a housing including a first frame and a second frame jointed to the first frame. The second frame includes: a first contact part configured to contact the agitation film, and a second contact part configured to contact the agitation film, arranged at a downstream side of the first contact part, the second contact part protruding towards the first frame. A first distance from the rotational axis line to the first contact part, as seen from a direction of the rotational axis line, is gradually increased towards a downstream side with respect to the rotating direction. A second distance from the rotational axis line to the second contact part is equal to or greater than a maximum distance from the rotational axis line to the first contact part.

17 Claims, 5 Drawing Sheets

DEVELOPING DEVICE INCLUDING HOUSING HAVING FIRST FRAME THAT SUPPORTS AGITATION MEMBER AND SECOND FRAME JOINTED TO FIRST FRAME AND CONFIGURED TO ACCOMMODATE DEVELOPER

CROSS REFERENCE TO RELATED APPLICATION

This application is based upon and claims the benefit of priority of Japanese Patent Application No. 2014-000606 filed on Jan. 6, 2014 the contents of which are incorporated herein by reference in its entirety.

BACKGROUND

The present invention relates to an electrophotographic developing device.

As an image forming apparatus, a printer including a detachable developing cartridge configured to accommodate therein toner has been known.

As the developing cartridge, a developing cartridge including a developing frame configured by a first frame and a second frame and an agitator arranged in the developing frame and including an agitation film configured to agitate the toner has been known.

The agitator is configured to rotate the agitation film with being contacted to an inside of the developing frame, thereby agitating the toner in the developing frame.

According to the related developing cartridge, the agitation film is furiously opened at a jointed part between the first and second frames of the developing frame and thus collides with an inner surface of the developing frame, so that a noise may be caused.

SUMMARY

It is therefore an object of the present invention to provide a developing device capable of suppressing a noise.

According to an aspect of the present disclosure, a developing device includes:

an agitation member configured to agitate developer, the agitation member including an agitation film and configured to rotate in a rotating direction with respect to a rotational axis line; and a housing including a first frame configured to support the agitation member and a second frame jointed to the first frame, and configured to accommodate therein the developer, wherein the second frame comprises:

a first contact part configured to contact the agitation film, and a second contact part configured to contact the agitation film, arranged at a downstream side of the first contact part with respect to the rotating direction of the agitation member, the second contact part protruding towards the first frame, wherein a first distance from the rotational axis line to the first contact part, as seen from a direction of the rotational axis line, is gradually increased towards a downstream side with respect to the rotating direction, and wherein a second distance from the rotational axis line to the second contact part is equal to or greater than a maximum distance from the rotational axis line to the first contact part.

DESCRIPTION OF ILLUSTRATIVE EMBODIMENTS

1. Outlines of Developing Cartridge

Figure 1:
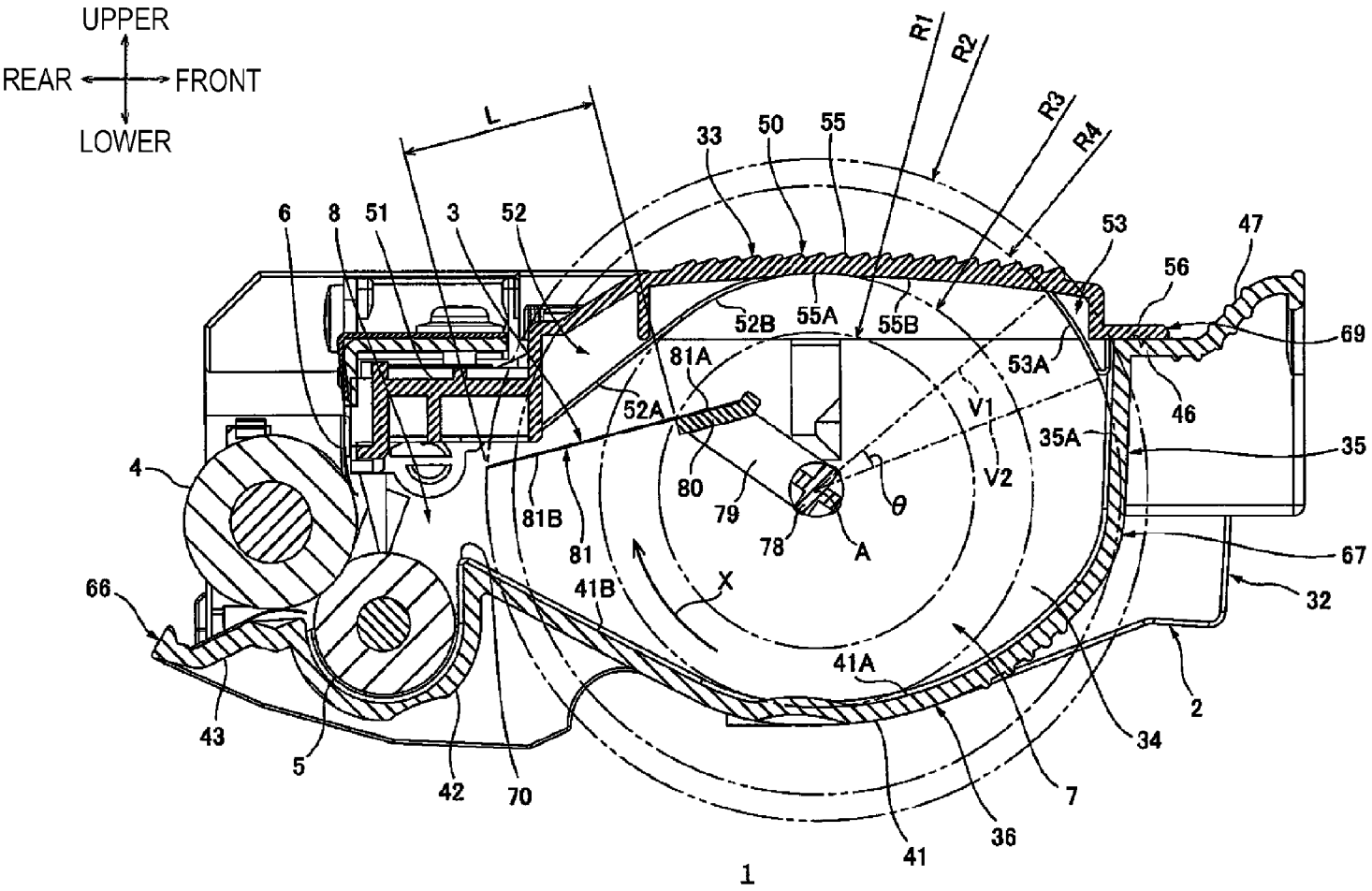
FIG. 1 is a central sectional view of a developing cartridge of the present invention.

As shown in FIG. 1, a developing cartridge 1, which is an example of the developing device, includes a developing frame 2, which is an example of the housing, an agitator 3, which is an example of the agitation member, a developing roller 4, a supply roller 5 and a layer thickness regulation blade 6.

Meanwhile, in below descriptions, the directions of the developing cartridge 1 are described on the basis of a state where the developing cartridge 1 is horizontally placed. That is, the upper side of the sheet of FIG. 1 is the upper side and the lower side of the sheet is the lower side. The right side of the sheet of FIG. 1 is the front side and the left side of the sheet of FIG. 1 is the rear side. The left and right sides are set on the basis of a state where the developing cartridge 1 is seen from the front side. That is, the front side of the sheet of FIG. 1 is the left side and the inner side of the sheet is the right side. In the meantime, the front-rear direction is an example of the orthogonal direction, and the left-right direction is an example of the direction of the rotational axis line.

The developing frame 2 has a substantial box shape extending in the left-right direction, and a rear end portion of the developing frame 2 is opened in the front-rear direction. The developing frame 2 includes therein a toner accommodation chamber 7, which is an example of the developer accommodation chamber, and a developing chamber 8, which are provided in parallel in the front-rear direction. The toner accommodation chamber 7 is configured to accommodate therein toner, which is an example of the developer. The toner accommodated in the toner accommodation chamber 7 is positively charged, non-magnetic pulverized toner of one component manufactured by a pulverization method.

The agitator 3 is arranged at a substantial middle part of the toner accommodation chamber 7 in the front-rear and upper-lower directions so that it can be rotated in a clockwise direction with respect to a rotational axis line A, as seen from the left side. The rotating direction of the agitator 3 is denoted with a rotating direction X.

The developing roller 4 is rotatably supported to a rear end portion of the developing chamber 8. Upper and rear parts of the developing roller 4 are exposed from the developing frame 2.

The supply roller 5 is rotatably supported to the developing chamber 8 at a front-lower side of the developing roller 4. A rear-upper end portion of the supply roller 5 is pressure-contacted to a front-lower end portion of the developing roller 4.

The layer thickness regulation blade 6 is arranged at a front-upper side of the developing roller 4. A lower end portion of the layer thickness regulation blade 6 is contacted to a front end portion of the developing roller 4.

2. Using Aspect of Developing Cartridge

Figure 2:
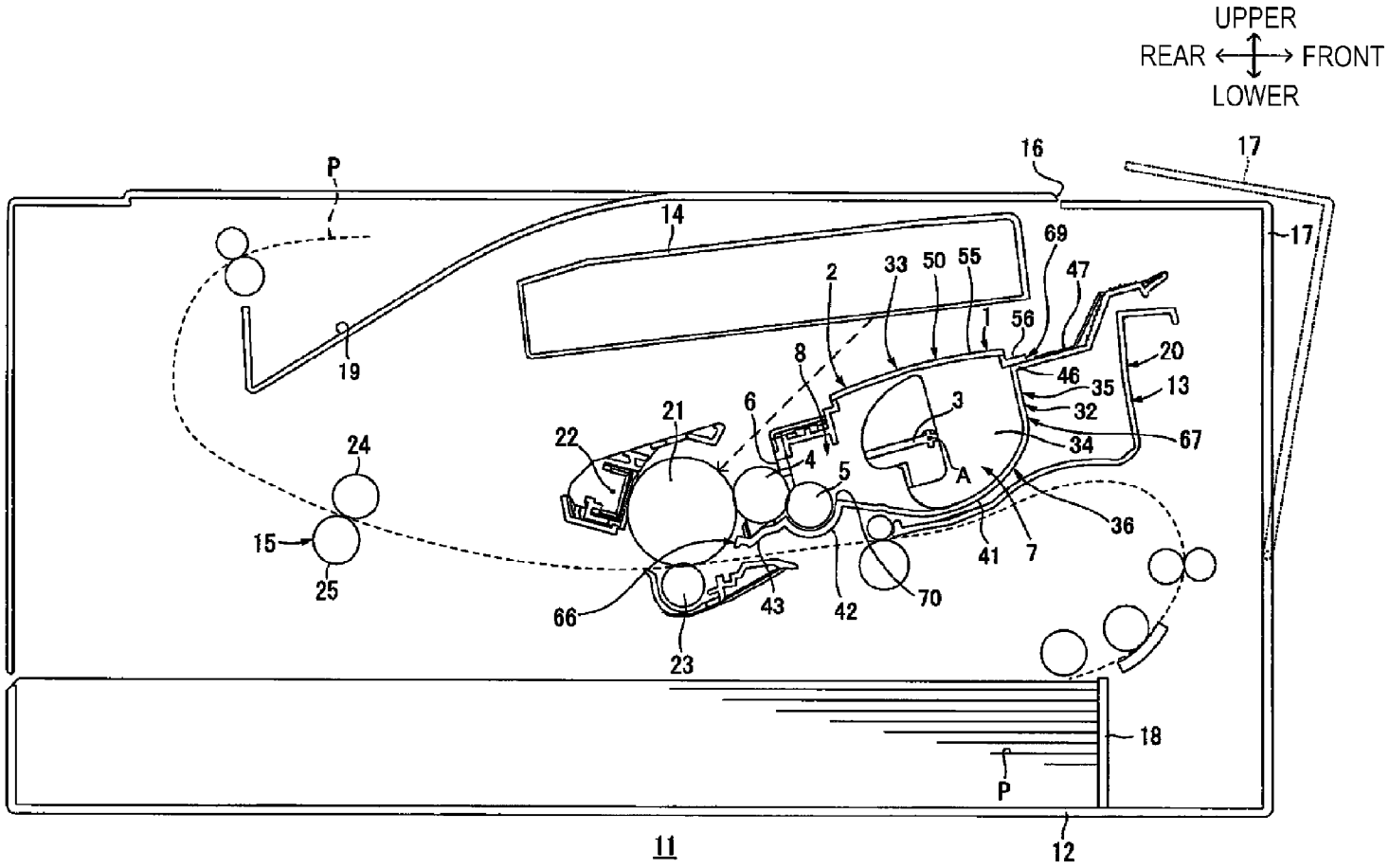
FIG. 2 is a central sectional view of an image forming apparatus including the developing cartridge shown in FIG. 1 mounted thereto.

As shown in FIG. 2, the developing cartridge 1 is used with being mounted to an image forming apparatus 11.

The image forming apparatus 11 is an electrophotographic monochrome printer. The image forming apparatus 11 includes an apparatus main body 12, a process cartridge 13, a scanner unit 14 and a fixing unit 15.

The apparatus main body 12 has a substantial box shape. The apparatus main body 12 includes an opening 16, a front cover 17, a sheet feeding tray 18 and a sheet discharge tray 19.

The opening 16 is arranged at a front end portion of the apparatus main body 12. The opening 16 is configured to communicate the inside and outside of the apparatus main body 12 in the front-rear direction so that the process cartridge 13 can pass therethrough.

The front cover 17 is arranged at the front end portion of the apparatus main body 12. The front cover 17 has a substantially L-shaped plate shape, as seen from the side. The front cover 17 is swingably supported to a front wall of the apparatus main body 12 at a lower end portion thereof serving as a support point. The front cover 17 is configured to open or close the opening 16.

The sheet feeding tray 18 is arranged at a bottom of the apparatus main body 12. The sheet feeding tray 18 is configured to accommodate therein sheets P.

The sheet discharge tray 19 is arranged at a rear half part of an upper wall of the apparatus main body 12. The sheet discharge tray 19 is formed to have a recess shape downwardly from an upper surface of the apparatus main body 12 so that the sheets P can be placed thereon.

The process cartridge 13 is arranged at a substantial center of the apparatus main body 12 in the upper-lower direction. The process cartridge 13 is configured to be mounted or demounted to or from the apparatus main body 12. The process cartridge 13 includes a drum cartridge 20 and the developing cartridge 1.

The drum cartridge 20 includes a photosensitive drum 21, a scorotron-type charger 22 and a transfer roller 23.

The photosensitive drum 21 is rotatably supported to a rear end portion of the drum cartridge 20.

The scorotron-type charger 22 is arranged at an interval with the photosensitive drum 21 at the rear of the photosensitive drum 21.

The transfer roller 23 is arranged below the photosensitive drum 21. An upper end portion of the transfer roller 23 is contacted to a lower end portion of the photosensitive drum 21.

The developing cartridge 1 is mounted to the drum cartridge 20 so that a rear end portion of the developing roller 4 is contacted to a front end portion of the photosensitive drum 21 in front of the photosensitive drum 21.

The scanner unit 14 is arranged above the process cartridge 13. The scanner unit 14 is configured to emit a laser beam based on image data towards the photosensitive drum 21.

The fixing unit 15 is arranged at the rear of the process cartridge 13. The fixing unit 15 includes a heating roller 24 and a pressing roller 25 pressure-contacted to a rear-lower end portion of the heating roller 24.

When the image forming apparatus 11 starts an image forming operation, the scorotron-type charger 22 uniformly charges a surface of the photosensitive drum 21. The scanner unit 14 exposes the surface of the photosensitive drum 21. Thereby, an electrostatic latent image based on the image data is formed on the surface of the photosensitive drum 21.

The agitator 3 agitates the toner in the toner accommodation chamber 7, thereby supplying the same to the supply roller 5. The supply roller 5 supplies the toner supplied by the agitator 3 to the developing roller 4. At this time, the toner is carried on the developing roller 4 with being positively friction-charged between the developing roller 4 and the supply roller 5. The layer thickness regulation blade 6 is configured to regulate a layer thickness of the toner carried on the developing roller 4 to a predetermined thickness.

The toner carried on the developing roller 4 is supplied to the electrostatic latent image on the surface of the photosensitive drum 21. Thereby, a toner image is carried on the surface of the photosensitive drum 21.

The sheet P is fed one by one at predetermined timing from the sheet feeding tray 18 towards between the photosensitive drum 21 and the transfer roller 23 by rotations of various rollers. The toner image on the surface of the photosensitive drum 21 is transferred to the sheet P while the sheet P passes between the photosensitive drum 21 and the transfer roller 23.

After that, the sheet P is heated and pressed while it passes between the heating roller 24 and the pressing roller 25. Thereby, the toner image on the sheet P is heat-fixed on the sheet P. Thereafter, the sheet P is discharged to the sheet discharge tray 19.

3. Details of Developing Cartridge

Figure 3:
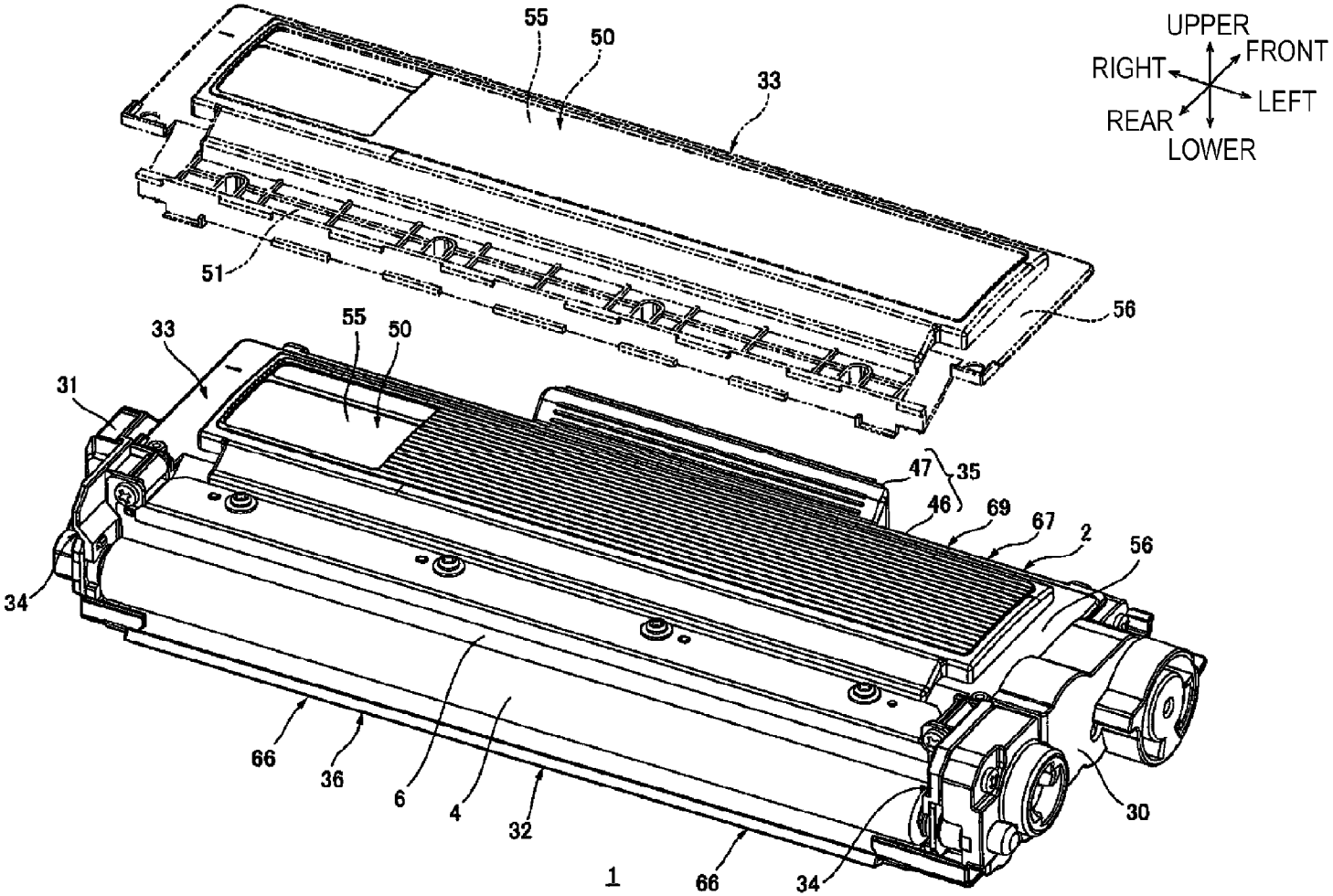
FIG. 3 is a perspective view of the developing cartridge shown in FIG. 1, as seen from the rear-upper side.

As shown in FIG. 3, the developing cartridge 1 includes the developing frame 2.

In the meantime, the developing cartridge 1 includes a driving unit 30 including a gear train (not shown), to which a driving force is input from the apparatus main body 12, at the left side of the developing frame 2. The developing cartridge 1 includes an electrode unit 31, to which the power is fed from the outside, at the right side of the developing frame 2.

Figure 4A:
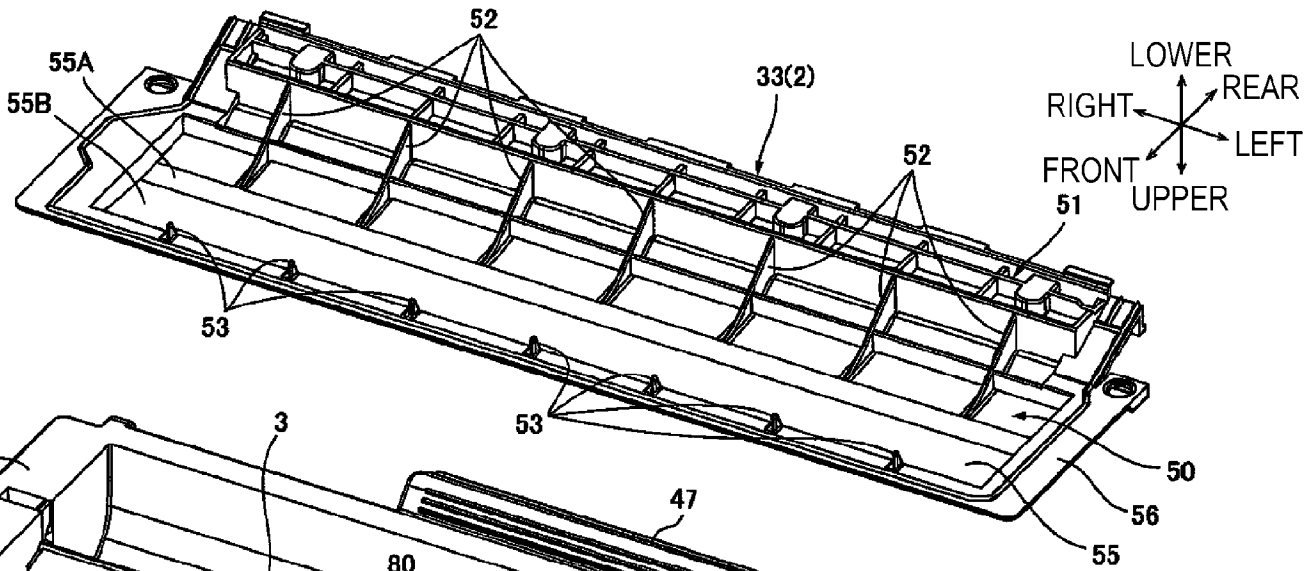
FIG. 4A is a perspective view of a cover frame shown in FIG. 3, as seen from the front-lower side.
Figure 4B:
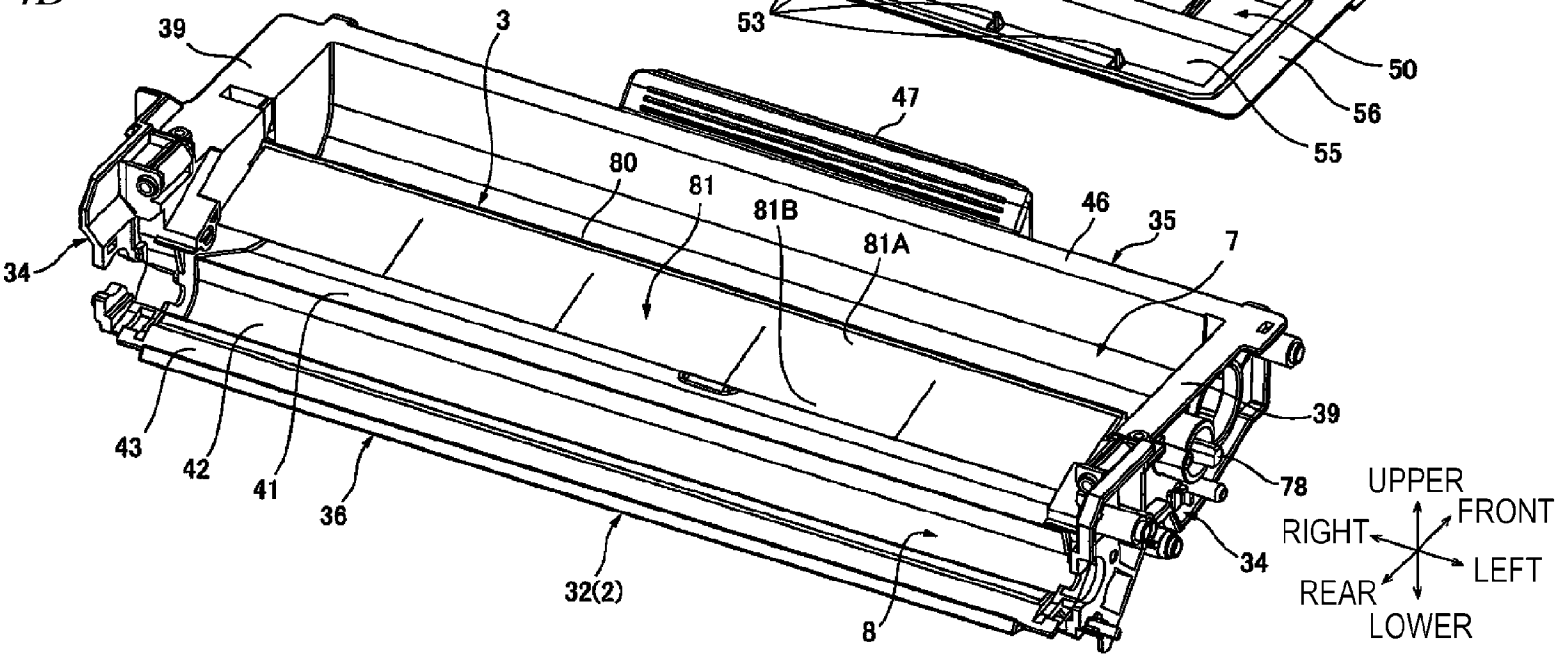
FIG. 4B is a perspective view of a base frame shown in FIG. 3, as seen from the rear-upper side.

As shown in FIGS. 3, 4A and 4B, the developing frame 2 includes a base frame 32, which is an example of the first frame, and a cover frame 33, which is an example of the second frame.

(1) Base Frame

As shown in FIG. 4B, the base frame 32 has a bottomed frame shape. The base frame 32 integrally includes a pair of sidewalls 34, a lower wall 36 and a front wall 35.

The pair of sidewalls 34 is arranged at both end portions of the base frame 32 in the left-right direction, respectively. Each of the pair of sidewalls 34 has a substantially rectangular plate shape extending in the front-rear direction, as seen from the side. Each of the pair of sidewalls 34 includes a collar part 39.

The collar part 39 protrudes outwardly from an upper end portion of each sidewall 34 in the left-right direction and extends in the front-rear direction. The collar part 39 has a substantially rectangular plate shape, as seen from the plan view.

The lower wall 36 is arranged at a lower end portion of the base frame 32, as shown in FIGS. 1 and 4B. The lower wall 36 is bridged between the pair of sidewalls 34. The lower wall 36 has a substantial plate shape extending in the left-right direction. The lower wall 36 integrally includes a first part 41, a second part 42 and a third part 43.

The first part 41 is arranged at a front half part of the lower wall 36. As shown in FIG. 1, the first part 41 has a substantial arc shape, as seen from the section. A center of the first part 41 in the front-rear direction is recessed downwardly. An inner surface of the first part 41 facing the rotational axis line A of the agitator 3 includes a front inner surface 41A and a rear inner surface 41B.

The front inner surface 41A is curved to be dented in the front-lower direction from a front end portion of the first part 41 to a substantial center of the first part 41 in the front-rear direction so that a distance from the rotational axis line A is gradually shortened. That is, the front inner surface 41A is formed so that the distance from the rotational axis line A is gradually shorter as it faces a downstream side with respect to the rotating direction X of the agitator 3.

The rear inner surface 41B is formed continuously to a rear end portion of the front inner surface 41A and is inclined upwardly as it faces rearwards so that the distance from the rotational axis line A is gradually increased. That is, the rear inner surface 41B is formed so that the distance from the rotational axis line A is gradually longer as it faces the downstream side with respect to the rotating direction X of the agitator 3.

The second part 42 is arranged at the rear of the first part 41. The second part 42 has a substantial arc shape, as seen from the section. The second part 42 is formed continuously to a rear end portion of the first part 41 and extends rearwards so that it is curved along an outer periphery of the supply roller 5.

The third part 43 is arranged at the rear of the second part 42. The third part 43 has a substantial linear shape, as seen from the section. The third part 43 is formed continuously to a rear end portion of the second part 42 and extends rearwards.

As shown in FIGS. 1 and 4B, the front wall 35 is arranged at a front end portion of the base frame 32. The front wall 35 is formed continuously to a front end portion of the lower wall 36 and extends upwards. The front wall 35 is bridged between the pair of sidewalls 34. An inner surface 35A of the front wall 35 facing the rotational axis line A of the agitator 3 extends in the upper-lower direction so that the distance from the rotational axis line A is gradually shorter. That is, the inner surface 35A is formed so that the distance from the rotational axis line A is gradually shorter as it faces towards the downstream side with respect to the rotating direction X of the agitator 3. A lower end portion of the inner surface 35A is formed continuously to a front end portion of the front inner surface 41A of the first part 41 of the lower wall 36. The front wall 35 includes a collar part 46 and a gripping part 47.

The collar part 46 protrudes forwards from an upper end portion of the front wall 35 and extends in the left-right direction. The collar part 46 has a substantially rectangular plate shape, as seen from the plan view. Both left and right end portions of the collar part 46 are formed continuously to the front end portions of the collar parts 39 of the pair of sidewalls 34. That is, an upper surface of the collar part 46 is flush with upper surfaces of the collar parts 39 of the pair of sidewalls 34.

The gripping part 47 is bulged rearwards from a substantial center part of a front surface of the front wall 35 in the left-right direction. The gripping part 47 has a substantially U-shaped plate shape of which the lower part is opened, as seen from the front.

(2) Cover Frame

As shown in FIG. 3, the cover frame 33 is arranged at the upper side of the base frame 32. As shown in FIGS. 3 and 4A, the cover frame 33 integrally includes a covering part 50, a blade support part 51, first ribs 52, and second ribs 53, which are an example of the rib.

The covering part 50 configures most of the front side of the cover frame 33. The covering part 50 has a substantially rectangular plate shape, as seen from the plan view. The covering part 50 includes a main body part 55 and a collar part 56.

The main body part 55 is arranged at the center of the covering part 50, as seen from the plan view. The main body part 55 has a substantially rectangular frame shape of which an upper end portion is closed and a lower end portion is opened, as seen from the plan view. A lower surface of the main body part 55, i.e., an inner surface of the main body part 55 facing the rotational axis line A of the agitator 3 includes a first curved surface 55A and a second curved surface 55B.

The first curved surface 55A is slightly dented upwards at a substantial center of the inner surface of the main body part 55 in the front-rear direction so that a distance from the rotational axis line A is constant.

The second curved surface 55B is a part corresponding from a front end portion of the first curved surface 55A of the inner surface of the main body part 55 to a rear-upper end portion of the second rib 53 (which will be described later). The second curved surface 55B extends in the front-rear direction so that a distance from the rotational axis line A is gradually longer as it faces forwards. That is, the second curved surface 55B is formed so that the distance from the rotational axis line A is gradually increased as it faces the downstream side with respect to the rotating direction X of the agitator 3. The second curved surface 55B is slightly dented upwards. The second curved surface 55B is configured as an example of the first contact part.

The collar part 56 is arranged at both left and right end portions and a front end portion of the covering part 50 so that it surrounds the main body part 55. The collar part 56 protrudes outwardly from lower end portions of both left and right end portions of the main body part 55 in the left-right direction and extends in the front-rear direction, and also protrudes forwardly from a lower end portion of the front end portion of the main body part 55 and extends in the left-right direction. The collar part 56 has a substantial plate shape.

As shown in FIGS. 1 and 3, the blade support part 51 is arranged at the rear side of the covering part 50. The blade support part 51 has a substantial thick plate shape continuing to a rear-lower end edge of the main body part 55 and extending rearwards.

As shown in FIGS. 1 and 4A, the first ribs 52 are arranged on a lower surface of the cover frame 33 at a substantial center part in the front-rear direction. The first rib 52 has a substantially triangular plate shape connecting a front surface of the blade support part 51 and a lower surface of the main body part 55 of the covering part 50 at the rear side thereof, as seen from the side. A front-lower end portion of the first rib 52, i.e., an inner surface of the first rib 52 facing the rotational axis line A of the agitator 3 includes an inclined surface 52A and a curved surface 52B.

The inclined surface 52A continues to the front surface of the blade support part 51 and is inclined upwardly so that a distance from the rotational axis line A is gradually shorter as it faces forwards. That is, the inclined surface 52A is formed so that the distance from the rotational axis line A is gradually shortened as it faces the downstream side with respect to the rotating direction X of the agitator 3.

The curved surface 52B continues to a front end portion of the inclined surface 52A and is curved so that an angle relative to the main body part 55 becomes gradually gentle and a distance from the rotational axis line A is constant. A front end portion of the curved surface 52B continues to a rear end portion of the first curved surface 55A of the main body part 55.

A plurality of the first ribs 52, specifically the seven first ribs 52 are arranged in parallel at an interval in the left-right direction.

The second ribs 53 are arranged on the lower surface at the front side. The second rib 53 has a substantially triangular plate shape protruding downwardly from the front end portion of the main body part 55 of the covering part 50 and the rear end portion of the collar part 56, as seen from the side.

A rear-lower end portion of the second rib 53, i.e., an inner surface 53A of the second rib 53 facing the rotational axis line A of the agitator 3 continues to the front end portion of the second curved surface 55B and is inclined downwardly as it faces forwards from the rear. The inner surface 53A is slightly dented in the front-lower direction so that a distance from the rotational axis line A is constant. The inner surface 53A is configured as an example of the second contact part.

A front surface of the second rib 53 extends in the upper-lower direction.

A plurality of the second ribs 53, specifically the seven second ribs 53 are arranged in parallel at an interval in the left-right direction. More specifically, each of the seven second ribs 53 overlaps with the corresponding first rib 52, as projected in the front-rear direction.

(3) Developing Frame

As shown in FIGS. 1 and 3, the developing frame 2 is configured by combining the base frame 32 and the cover frame 33.

Specifically, a lower surface of the collar part 56 of the covering part 50 of the cover frame 33 abuts on upper surfaces of the collar parts 39 of the pair of sidewalls 34 of the base frame 32 and an upper surface of the collar part 46 of the front wall 35, from the upper. At this time, the second ribs 53 protrude towards the base frame 32, and the front surfaces of the second ribs 53 of the cover frame 33 are mounted and contacted to the rear surface of the front wall 35 of the base frame 32, so that the cover frame 33 can be simply positioned relative to the base frame 32.

The collar part 56 of the cover frame 33 and the collar parts 39 of the sidewalls 34 of the base frame 32 and the collar part 46 of the front wall 35 are welded, so that the cover frame 33 is mounted to the base frame 32.

An end portion of the developing frame 2 configured as described above in the front-rear direction, at which the developing roller 4 is disposed, i.e., a rear end portion is referred to as a first end portion 66, and an end portion opposite to the first end portion 66 in the front-rear direction, i.e., a front end portion is referred to as a second end portion 67.

In the meantime, the welded part between the collar part 56 of the cover frame 33 and the collar part 46 of the front wall 35 of the base frame 32 at the second end portion 67 configures a jointed part 69. That is, in the developing frame 2, the second ribs 53 are arranged with striding across the jointed part 69 in the upper-lower direction.

In the developing frame 2 configured as described above, the toner accommodation chamber 7 is demarcated by a front space of the developing frame 2, i.e., by the front part of the pair of sidewalls 34, the front wall 35, the first part 41 of the lower wall 36 and the covering part 50 of the cover frame 33, as shown in FIG. 1.

In the developing frame 2, the developing chamber 8 is demarcated by a rear space of the developing frame 2, i.e., by the rear part of the pair of sidewalls 34, the second part 42 of the lower wall 36 and the blade support part 51 of the cover frame 33.

A part configured to enable the toner accommodation chamber 7 and the developing chamber 8 in the developing frame 2 to communicate with each other in the front-rear direction is demarcated as an opening 70.

4. Agitator

As shown in FIGS. 1 and 4B, the agitator 3 includes an agitator shaft 78, connection plates 79, a film holding plate 80 and an agitation film 81.

The agitator shaft 78 has a substantial cylindrical shape extending in the left-right direction.

Although not shown, the connection plates 79 are arranged in parallel at an equal interval in the left-right direction. The connection plate 79 extends from a part of a peripheral surface of the agitator shaft 78 towards a diametrically outer direction of the agitator shaft 78. The connection plate 79 has a substantially rectangular plate shape, as seen from the side.

The film holding plate 80 continues to end portions of the plurality of connection plates 79 opposite to the agitator shaft 78. The film holding plate 80 extends in the left-right direction and has a substantial plate shape inclined so that it deviates from the agitator shaft 78 as it faces the upstream side with respect to the rotating direction X of the agitator 3. In the meantime, a distance from the rotational axis line A to a tip of the film holding plate 80, as seen from the side, is defined as a distance R1. The distance R1 from the rotational axis line A to the tip of the film holding plate 80 is 5 mm or greater, preferably 10 mm or greater and 20 mm or less, preferably 16 mm or less, for example. More specifically, the distance R1 is 14.5 mm.

The agitation film 81 is made of a flexible film material such as polyethylene terephthalate (PET) and the like. The agitation film 81 has a substantially rectangular shape extending over an entire region of the film holding plate 80 in the left-right direction. A thickness of the agitation film 81 is 0.50 mm or greater, preferably 0.75 mm or greater and 1.50 mm or less, preferably 1.25 mm or less, for example. More specifically, the thickness is 0.10 mm. One end of the agitation film 81 is jointed to the film holding plate 80, so that the agitation film 81 is held at the film holding plate 80. That is, the agitation film 81 is inclined so that it deviates from the agitator shaft 78 as it faces the upstream side with respect to the rotating direction X of the agitator 3, like the film holding plate 80.

In the meantime, the end portion of the agitation film 81 jointed to the film holding plate 80 is referred to as a base end portion 81A.

A part except for the base end portion 81A, which is not jointed to the film holding plate 80, is referred to as a free end portion 81B. A size of the free end portion 81B, as seen from the side, is referred to as a film free end portion size L. The film free end portion size L is 10 mm or greater, preferably 15 mm and 30 mm or less, preferably 25 mm or less, for example. More specifically, the film free end portion size L is 18 mm.

Further, a distance from the rotational axis line A to a tip of the free end portion 81B, as seen from the side, is referred to as a distance R2. The distance R2 from the rotational axis line A to the tip of the free end portion 81B is 20 mm or greater, preferably 25 mm or greater and 40 mm or less, preferably 35 mm, for example. More specifically, the distance R2 is 30.5 mm.

5. Size Relation Between Rotational Axis Line of Agitator and Inner Surface of Toner Accommodation Chamber A size relation between the rotational axis line A of the agitator 3 and the inner surface of the toner accommodation chamber 7 is described in detail.

A distance from the rotational axis line A to the curved surface 52B and a distance from the rotational axis line A to the first curved surface 55A are the same, and a distance from the rotational axis line A is shortest in the toner accommodation chamber 7. The shortest distance from the rotational axis line A to the inner surface of the toner accommodation chamber 7 is referred to as the shortest distance R3. The shortest distance R3 from the rotational axis line A to the inner surface of the toner accommodation chamber 7 is 10 mm or greater, preferably 15 mm or greater and 30 mm or less, preferably 25 mm, for example. More specifically, the shortest distance R3 is 20 mm.

In the meantime, a distance from the rotational axis line A to a continuous part of the front inner surface 41A and rear inner surface 41B of the first part 41 is substantially the same as the shortest distance R3 from the rotational axis line A to the inner surface of the toner accommodation chamber 7.

As described above, a distance from the rotational axis line A to the inner surface 53A of the second rib 53 is constant, irrespective of the downstream and upstream with respect to the rotating direction X of the agitator 3, and the distance from the rotational axis line A to the inner surface 53A of the second rib 53 is referred to as a distance R4. The distance R4 from the rotational axis line A to the inner surface 53A of the second rib 53 is 10 mm or greater, preferably 20 mm or greater and 90 mm or less, preferably 45 mm, for example. More specifically, the distance R4 is 28 mm. In other words, the distance R4 is the same as a distance from the rotational axis line A to the connection part of the main body part 55 with the second rib 53, i.e., the maximum distance from the rotational axis line A to the second curved surface 55B.

The distance R4 from the rotational axis line A to the inner surface 53A of the second rib 53 is 100% or greater, preferably 120% or greater and 300% or less, preferably 150% or less of the shortest distance R3 from the rotational axis line A to the inner surface of the toner accommodation chamber 7. More specifically, the distance R4 is 140%.

In the meantime, when assuming a virtual line V1 connecting the rotational axis line A and a rear-upper end portion of the inner surface 53A of the second rib 53 and a second virtual line V2 connecting the rotational axis line A and a front-lower end portion of the inner surface 53A of the second rib 53, an angle θ between the first virtual line V1 and the second virtual line V2 is 10° or greater, preferably 15° or greater and 90° or less, preferably 45° or less. More specifically, the angle is 20°.

6. Operation of Agitating Toner in Toner Accommodation Chamber by Agitator

As shown in FIG. 1, when the developing cartridge 1 is shipped and delivered as a new product, the free end portion 81B of the agitation film 81 of the agitator 3 is arranged in the opening 70 so that it is not contacted to the developing frame 2.

Figure 5:
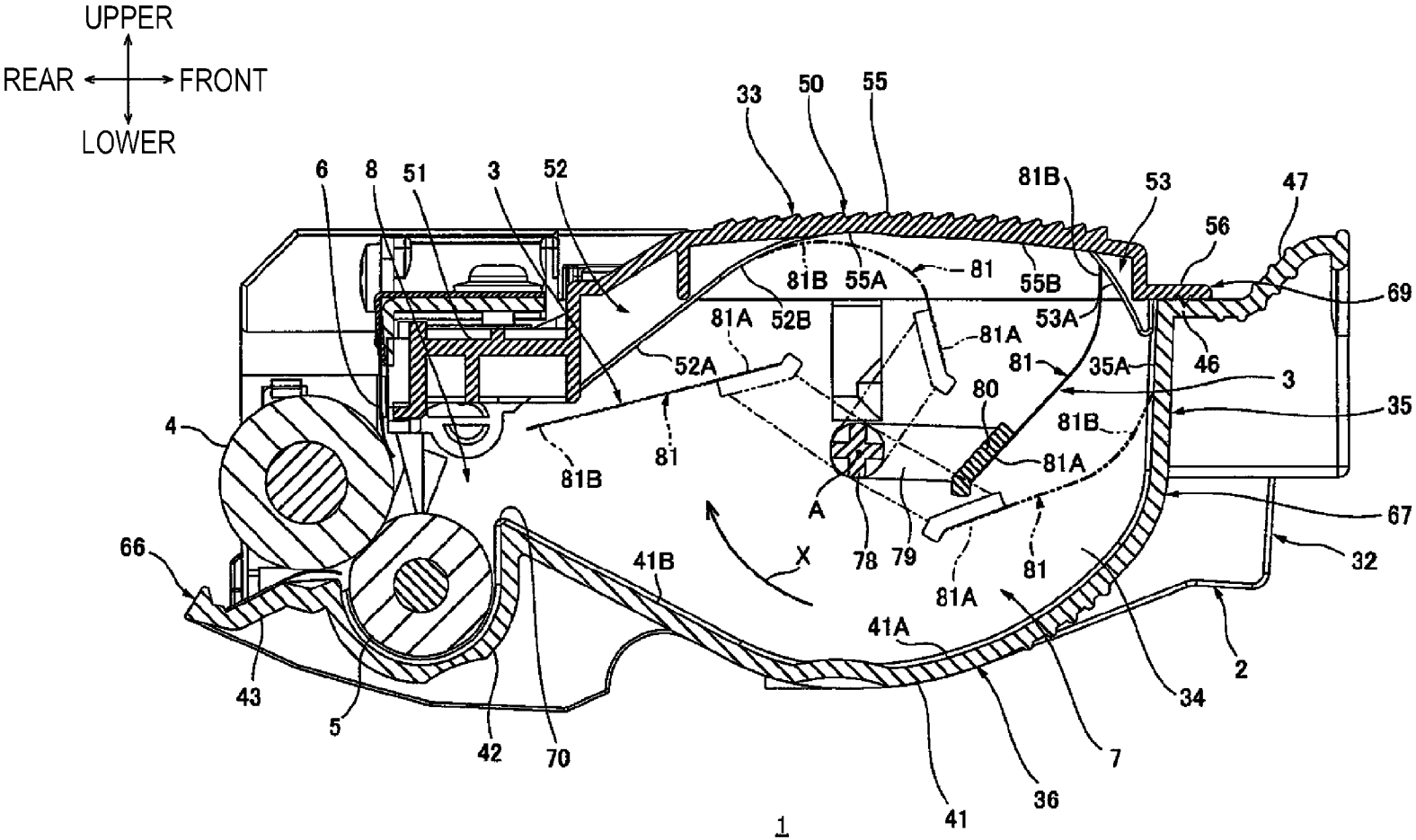
FIG. 5 illustrates an operation of an agitator shown in FIG. 1.

As shown in FIGS. 2 and 3, when a user mounts the developing cartridge 1 to the apparatus main body 12 and the image forming apparatus 11 starts an image forming operation under control of a control unit (not shown), a driving force is input to the developing cartridge 1 from a driving input unit (not shown) of the apparatus main body 12. When the driving force is input to the developing cartridge 1, the driving force is transmitted to the agitator 3 via the gear train (not shown) of the driving unit 30. As the driving force is transmitted, the agitator 3 is rotated in a clockwise direction, as seen from the left side, i.e., in the rotating direction X, as shown in FIG. 5.

As the agitator 3 is rotated in the rotating direction X, the free end portion 81B of the agitation film 81 is contacted to the inclined surface 52A of the first rib 52.

Thereby, the agitation film 81 is gradually bent as the agitator 3 is rotated in the rotating direction X.

When the agitator 3 is further rotated in the rotating direction X, the agitation film 81 is transferred from the inclined surface 52A of the first rib 52 to the curved surface 52B. Thereby, the free end portion 81B of the agitation film 81 is contacted to the curved surface 52B of the first rib 52.

When the agitator 3 is further rotated in the rotating direction X, the agitation film 81 is transferred from the curved surface 52B of the first rib 52 to the first curved surface 55A of the main body part 55. Thereby, the free end portion 81B of the agitation film 81 is contacted to the first curved surface 55A of the main body part 55.

In the meantime, when the free end portion 81B is contacted to the curved surface 52B of the first rib 52 and the first curved surface 55A of the main body part 55, the size from the rotational axis line A to the tip of the free end portion 81B is substantially the same as the shortest distance R3 from the rotational axis line A to the inner surface of the toner accommodation chamber 7.

Thereby, the agitation film 81 is most bent while it is contacted to the inner surface of the toner accommodation chamber 7 as the agitator 3 is rotated.

When the agitator 3 is further rotated in the rotating direction X, the agitation film 81 is transferred from the first curved surface 55A of the main body part 55 to the second curved surface 55B. Thereby, the free end portion 81B of the agitation film 81 is contacted to the second curved surface 55B of the main body part 55.

Thereby, the bent state of the agitation film 81 is gradually released as the agitator 3 is rotated in the rotating direction X.

When the agitator 3 is further rotated in the rotating direction X, the agitation film 81 is transferred from the second curved surface 55B of the main body part 55 to the inner surface 53A of the second rib 53. Thereby, the free end portion 81B of the agitation film 81 is contacted to the inner surface 53A of the second rib 53.

The bent state of the agitation film 81 is constant while the free end portion 81B of the agitation film 81 is contacted to the inner surface 53A of the second rib 53.

When the agitator 3 is further rotated in the rotating direction X, the agitation film 81 is transferred from the inner surface 53A of the second rib 53 to the inner surface 35A of the front wall 35 with striding across the jointed part 69. That is, the agitation film 81 is transferred from the cover frame 33 to the base frame 32 while the bent degree of the agitation film 81 is slightly changed between the lower end portion of the second rib 53 and the front wall 35. Thereby, the free end portion 81B of the agitation film 81 is contacted to the inner surface 35A of the front wall 35.

Then, the agitation film 81 is gradually bent as the agitator 3 is rotated in the rotating direction X.

When the agitator 3 is further rotated in the rotating direction X, the agitation film 81 is transferred from the inner surface 35A of the front wall 35 to the front inner surface 41A of the first part 41 of the lower wall 36. Thereby, the free end portion 81B of the agitation film 81 is contacted to the front inner surface 41A of the first part 41.

Thereby, the agitation film 81 is gradually bent as it is transferred towards the downstream side with respect to the rotating direction X of the agitator 3.

When the free end portion 81B is contacted to the continuous part of the front inner surface 41A and rear inner surface 41B, the size from the rotational axis line A to the tip of the free end portion 81B is substantially the same as the shortest distance R3 from the rotational axis line A to the inner surface of the toner accommodation chamber 7, like when the free end portion 81B is contacted to the curved surface 52B of the first rib 52 and the first curved surface 55A of the main body part 55.

Thereby, the agitation film 81 is most bent while it is contacted to the inner surface of the toner accommodation chamber 7 as the agitator 3 is rotated.

When the agitator 3 is further rotated in the rotating direction X, the agitation film 81 is transferred from the front inner surface 41A of the first part 41 of the lower wall 36 to the rear inner surface 41B. Thereby, the free end portion 81B of the agitation film 81 is contacted to the rear inner surface 41B of the first part 41.

Then, the bent state of the agitation film 81 is gradually released as it is transferred towards the downstream side with respect to the rotating direction X of the agitator 3.

Then, the free end portion 81B of the agitation film 81 is spaced from the rear inner surface 41B at the rear end portion of the rear inner surface 41B of the first part 41 of the lower wall 36, so that the agitation film 81 is restored as the bent state thereof is removed. The agitation film 81 scrapes and delivers the toner in the toner accommodation chamber 7 from the front to the rear towards the developing chamber 8 through the opening 70 by the elastic force of the agitation film 81.

When the agitator 3 is further rotated in the rotating direction X, the free end portion 81B of the agitation film 81 is again contacted to the inclined surface 52A of the first rib 52. Then, the above-described rotating operations are repeated.

In this way, as the agitator 3 is rotated, the free end portion 81B of the agitation film 81 is contacted to the inclined surface 52A of the first rib 52, the first curved surface 55A and second curved surface 55B of the main body part 55, the inner surface 53A of the second rib 53, the inner surface 35A of the front wall 35 and the front inner surface 41A and rear inner surface 41B of the first part 41 of the lower wall 36 and the bent degree thereof is changed, so that the toner in the toner accommodation chamber 7 is efficiently agitated. The toner in the toner accommodation chamber 7 is scraped towards the opening 70 and is thus effectively supplied to the developing chamber 8.

5. Operational Effects (1) As shown in FIGS. 1 and 5, according to the developing cartridge 1, the second curved surface 55B of the main body part 55 of the covering part 50 is configured so that the distance from the rotational axis line A is increased as it faces towards the downstream side with respect to the rotating direction X of the agitator 3. Thus, the bent state of the agitation film 81 is gradually released while the agitator 3 is rotated. The inner surface 53A of the second rib 53 is configured so that the distance R4 from the rotational axis line A to the inner surface 53A of the second rib 53 is the same as the maximum distance from the rotational axis line A to the second curved surface 55B of the main body part 55 of the covering part 50. Therefore, the agitation film 81 is transferred with a natural length thereof being substantially kept from the second curved surface 55B of the main body part 55 of the covering part 50 to the inner surface 53A of the second rib 53.

For this reason, it is possible to smoothly transfer the agitation film 81 from the second curved surface 55B of the main body part 55 of the covering part 50 to the inner surface 53A of the second rib 53 in the cover frame 33.

Since the inner surface 53A of the second rib 53 protrudes towards the base frame 32 and the agitation film 81 is kept at a state close to the natural length thereof at the time that the agitation film 81 is transferred from the cover frame 33 to the base frame 32, it is possible to smoothly transfer the agitation film 81 from the inner surface 53A of the second rib 53 to the base frame 32.

As a result, it is possible to suppress the bent state of the agitation film 81 from being furiously released at the time that the agitation film 81 is transferred from the cover frame 33 to the base frame 32.

Therefore, it is possible to smoothly transfer the agitation film 81 from the cover frame 33 to the base frame 32, thereby suppressing a noise.

(2) As shown in FIGS. 1 and 5, according to the developing cartridge 1, the second rib 53 is arranged so that it strides across the jointed part 69.

For this reason, even though a step occurs between the cover frame 33 and the base frame 32 when mounting the cover frame 33 and the base frame 32, the agitation film can be smoothly transferred from the cover frame 33 to the base frame 32.

(3) As shown in FIGS. 1 and 5, according to the developing cartridge 1, since the agitation film 81 is smoothly transferred from the cover frame 33 to the base frame 32 at the second end portion 67-side, it is possible to supply the toner in the developing frame 2, which is agitated at the second end portion 67-side, towards the developing roller 4 arranged at the first end portion 66 positioned at the opposite side in the front-rear direction.

As a result, it is possible to securely agitate the toner in the developing frame 2 and to positively supply the same to the developing roller 4.

(4) When the gripping part 47 is provided at the middle part of the base frame 32 in the left-right direction, the vibrations from the agitation film 81 of the agitator 3 being rotating in the developing frame 2 are transferred to outer parts of the gripping part 47 at the second end portion 67 in the left-right direction, so that the noise is likely to occur.

However, according to the developing cartridge 1, the agitation film 81 is smoothly transferred from the cover frame 33 to the base frame 32, as shown in FIGS. 1 and 5.

For this reason, it is possible to suppress the noise from the developing cartridge 1 while providing the gripping part 47 enabling the developing cartridge 1 to be easily gripped.

(5) As shown in FIGS. 1 and 5, according to the developing cartridge 1, it is possible to make the bent amount of the agitation film 81 constant while the agitation film 81 is contacted to the inner surface 53A of the second rib 53.

For this reason, it is possible to suppress the noise at the time that the agitation film 81 is contacted to the inner surface 53A of the second rib 53.

(6) As shown in FIGS. 1 and 5, according to the developing cartridge 1, the distance R4 from the rotational axis line A to the inner surface 53A of the second rib 53 is 140% of the shortest distance R3 from the rotational axis line A to the inner surface of the toner accommodation chamber 7. Therefore, it is possible to smoothly transfer the agitation film 81 from the second curved surface 55B of the main body part 55 of the covering part 50 of the cover frame 33 to the inner surface 53A of the second rib 53 while releasing the bent state thereof.

The shortest distance to the second curved surface 55B of the main body part 55 of the covering part 50 of the cover frame 33 is reduced, so that it is possible to make the developing frame 2 small.

(7) As shown in FIG. 1, according to the developing cartridge 1, since the distance R4 from the rotational axis line A to the inner surface 53A of the second rib 53 is 140% of the shortest distance R3 from the rotational axis line A to the inner surface of the toner accommodation chamber 7, it is possible to optimize the size of the developing frame 2.

(8) As shown in FIG. 5, according to the developing cartridge 1, since the thickness of the agitation film 81 is 0.10 mm, it is possible to suppress the noise while keeping the thickness capable of maintaining the agitation performance of the agitation film 81.

(9) As shown in FIG. 1, according to the developing cartridge 1, it is possible to keep the agitation film 81 unbent at a state where the developing cartridge 1 is provided as a new product.

For this reason, since it is possible to ship the developing cartridge while suppressing deterioration of the agitation film 81, it is possible to secure the agitation performance of the agitator 3 when in use.

(10) As shown in FIG. 1, according to the developing cartridge 1, it is possible to disable the free end portion 81B of the agitation film 81 from contacting the developing frame 2 by using the opening 70 for supplying the toner from the toner accommodation chamber 7 to the developing chamber 8.

For this reason, since it is not necessary to form a separate space for making the free end portion 81B of the agitation film 81 contactless, it is possible to suppress the developing frame 2 from being enlarged and to secure the agitation performance of the agitator 3.

(11) As shown in FIG. 4A, according to the developing cartridge 1, the inner surface 53A of the second rib 53, which is an example of the second contact part, is provided for each of the second ribs 53. Therefore, it is possible to reduce a frictional resistance at the time that the agitation film 81 is contacted to the inner surface 53A of the second rib 53.

Since it is possible to easily form the second rib 53 from the plurality of second ribs 53, it is possible to save the cost.

(12) As shown in FIGS. 1 and 5, according to the developing cartridge 1, since the sufficient size of the inner surface 53A of the second rib 53 is secured, it is possible to positively bring the agitation film 81 into contact with the inner surface 53A of the second rib 53 and to securely transfer the agitation film 81 from the cover frame 33 to the base frame 32.

As a result, it is possible to securely suppress the noise at the time that the agitation film 81 is transferred from the cover frame 33 to the base frame 32.

6. Modified Embodiments

The developing cartridge 1 is an illustrative embodiment of the developing cartridge of the present invention, and the present invention is not limited to the illustrative embodiment.

For example, the cartridge of the present invention may also be configured as an integral cartridge in which the developing cartridge 1 and the drum cartridge 20 are integrally provided, in addition to the separable cartridge in which the developing cartridge 1 and the drum cartridge 20 are configured to be separable from each other.

The present invention can be applied to a developing device that is fixed to the apparatus main body 12, in addition to the developing cartridge 1 that is detachably mounted to the apparatus main body 12.

In the above illustrative embodiment, the base frame 32 is configured to support the agitator 3. However, a configuration where the cover frame 33 is configured to support the agitator 3 can also be applied.

In the above illustrative embodiment, the cover frame 33 integrally includes the first ribs 52 and the second ribs 53. However, the cover frame 33 may also include the first ribs 52 and the second ribs 53, as separate members.

In the above illustrative embodiment, the first ribs 52 and the second ribs 53 are respectively provided in parallel at an interval in the left-right direction. However, a substantial plate shape member extending in the left-right direction and including an inner surface facing the rotational axis line A of the agitator 3 may also be applied.

In the above illustrative embodiment, the base frame 32 integrally includes the gripping part 47. However, the gripping part 47 may also be provided, as a separate member.

For example, a developer carrier such as a brush roller and a developing sleeve may be applied, instead of the developing roller 4.

In view of above, a first aspect of the present disclosure provides a developing device comprising:

an agitation member configured to agitate developer, the agitation member including an agitation film and configured to rotate in a rotating direction with respect to a rotational axis line; and a housing including a first frame configured to support the agitation member and a second frame jointed to the first frame, and configured to accommodate therein the developer, wherein the second frame comprises:

a first contact part configured to contact the agitation film, and a second contact part configured to contact the agitation film, arranged at a downstream side of the first contact part with respect to the rotating direction of the agitation member, the second contact part protruding towards the first frame, wherein a first distance from the rotational axis line to the first contact part, as seen from a direction of the rotational axis line, is gradually increased towards a downstream side with respect to the rotating direction, and wherein a second distance from the rotational axis line to the second contact part is equal to or greater than a maximum distance from the rotational axis line to the first contact part.

According to the above configuration, the first contact part is configured so that the distance from the rotational axis line is increased as it faces towards the downstream side with respect to the rotating direction of the agitation member. Thus, a bent state of the agitation film is gradually released while the agitation member is rotated. The second contact part is configured so that the distance from the rotational axis line to the second contact part is equal to or greater than the maximum distance from the rotational axis line to the first contact part. Therefore, the agitation film is transferred from the first contact part to the second contact part while the bent state of the agitation film is continuously released.

For this reason, it is possible to smoothly transfer the agitation film from the first contact part to the second contact part in the second frame.

Since the second contact part protrudes towards the first frame at the time that the agitation film is transferred from the second frame to the first frame, it is possible to smoothly transfer the agitation film from the second contact part to the first contact part.

As a result, it is possible to suppress the bent state of the agitation film from being furiously released at the time that the agitation film is transferred from the second frame to the first frame.

Therefore, it is possible to smoothly transfer the agitation film from the second frame to the first frame, thereby suppressing a noise.

According to a second aspect of the present disclosure, the second contact part is arranged to stride across a jointed part of a downstream end portion of the second frame with respect to the rotating direction and an upstream end portion of the first frame with respect to the rotating direction.

According to the above configuration, even though a step occurs between the second frame and the first frame when mounting the second frame and the first frame, the agitation film can be smoothly transferred from the second frame to the first frame.

According to a third aspect of the present disclosure, the developing device further comprises a developing roller, wherein the housing includes:

a first end portion at which the developing roller is arranged in an orthogonal direction orthogonal to the rotational axis line; and a second end portion arranged at an opposite side to the first end portion in the orthogonal direction, and wherein the second contact part protrudes from the second frame towards the first frame to stride across a jointed part where the first frame is jointed to the second frame at the second end portion.

According to the above configuration, since the agitation film is smoothly transferred from the second frame to the first frame at the second end portion-side, it is possible to supply the developer in the housing, which is agitated at the second end portion-side, towards the developing roller arranged at the first end portion positioned at the opposite side in the orthogonal direction.

As a result, it is possible to securely agitate the developer in the housing and to positively supply the same to the developing roller.

According to a fourth aspect of the present disclosure, the first frame is provided with a gripping part at a middle part of the second end portion in the direction of the rotational axis line.

When the gripping part is provided at a middle part of the first frame 32 in the direction of the rotational axis line, vibrations from the agitation film of the agitation member being rotating in the housing are transferred to outer parts of the gripping part at the second end portion in the direction of the rotational axis line, so that the noise is likely to occur.

However, according to the above configuration, the agitation film is smoothly transferred from the second frame to the first frame.

For this reason, it is possible to suppress the noise from the developing device while providing the gripping part enabling the developing device to be easily gripped.

According to a fifth aspect of the present disclosure, the second distance is constant over the entire second contact part.

According to the above configuration, it is possible to make a bent amount of the agitation film constant while the agitation film is contacted to the second contact part.

For this reason, it is possible to suppress the noise at the time that the agitation film is contacted to the second contact part.

According to a sixth aspect of the present disclosure, the second distance is 100 to 300% of a minimum of the first distance.

According to the above configuration, the distance from the rotational axis line to the second contact part is 100 to 300% of the shortest distance from the rotational axis line to the first contact part. Therefore, it is possible to smoothly transfer the agitation film from the first contact part to the second contact part while releasing the bent state thereof.

The shortest distance to the first contact part is reduced, so that it is possible to make the housing small.

According to a seventh aspect of the present disclosure, the second distance is 140% of the minimum of the first distance.

According to the above configuration, it is possible to optimize the size of the housing.

According to an eighth aspect of the present disclosure, a thickness of the agitation film is 0.50 mm or greater.

According to the above configuration, it is possible to suppress the noise while keeping the thickness capable of maintaining the agitation performance of the agitation film.

According to a ninth aspect of the present disclosure, a free end portion of the agitation member is not contacted to the housing at a state where the developing device is provided as a new product.

According to the above configuration, it is possible to keep the agitation film unbent.

For this reason, since it is possible to ship the developing device while suppressing deterioration of the agitation film, it is possible to secure the agitation performance of the agitation member when in use.

According to a tenth aspect of the present disclosure, the housing comprises:

a developing chamber configured to accommodate therein the developing roller;

a developer accommodation chamber configured to accommodate therein the agitation member; and an opening configured to cause the developing chamber and the developer accommodation chamber to communicate with each other, and wherein the free end portion is arranged in the opening at the state where the developing device is provided as the new product.

According to the above configuration, it is possible to disable a free end portion of the agitation film from contacting the housing by using the opening for supplying the developer from the developer accommodation chamber to the developing chamber.

According to an eleventh aspect of the present disclosure, the second contact part comprises a plurality of ribs arranged in the direction of the rotational axis line.

For this reason, since it is not necessary to form a separate space for making the free end portion of the agitation film contactless, it is possible to suppress the housing from being enlarged and to secure the agitation performance of the agitation member.

According to the above configuration, since the second contact part is configured by the plurality of ribs, it is possible to reduce a frictional resistance at the time that the agitation film is contacted to the second contact part.

Since it is possible to easily form the second contact part from the plurality of ribs, it is possible to save the cost.

According to a twelfth aspect of the present disclosure, when assuming a first virtual line connecting the rotational axis line and an upstream end portion of the second contact part with respect to the rotating direction and a second virtual line connecting the rotational axis line and a downstream end portion of the second contact part with respect to the rotating direction, as seen from the direction of the rotational axis line, an angle between the first virtual line and the second virtual line is 10° to 90°.

According to the above configuration, since a sufficient size of the second contact part is secured, it is possible to positively bring the agitation film into contact with the second contact part and to securely transfer the agitation film from the second frame to the first frame.

As a result, it is possible to securely suppress the noise at the time that the agitation film is transferred from the second frame to the first frame.

According to the developing device of the present invention, it is possible to suppress the noise.

What is claimed is:

1. A developing device comprising:

an agitation member configured to agitate developer, the agitation member including an agitation film and configured to rotate in a rotating direction with respect to a rotational axis line; and a housing including a first frame including an opening and configured to support the agitation member and a second frame welded to the first frame to cover the opening, and configured to accommodate therein the developer, wherein the second frame comprises:

a main body part covering the opening, the main body part including a surface and a side wall extending from the surface;

a collar part being welded to the first frame, the collar part having a plate shape and extending from an end of the side wall so that the main body part and the collar part form a step;

a first contact part configured to contact the agitation film, the first contact part including an arc surface; and a second contact part including a rib configured to contact the agitation film, arranged at a downstream side of the first contact part with respect to the rotating direction of the agitation member, wherein the rib extends from the main body part towards the first frame in a first direction orthogonal to a surface of the collar part, and the rib is connected to the main body part and the collar part, wherein a first distance from the rotational axis line to the first contact part, as seen from a direction of the rotational axis line, gradually increases towards a downstream side with respect to the rotating direction, wherein a second distance from the rotational axis line to the rib is equal to or greater than a maximum distance from the rotational axis line to the first contact part, wherein the rib includes a first end connected to the main body part, a second end connected to the collar part and a tip end extending from the first end and the second end, and wherein the first end, the second end and the tip end are arranged in this order in the first direction.

2. The developing device according to claim 1, further comprising a developing roller, wherein the housing includes:

a first end portion at which the developing roller is arranged in an orthogonal direction orthogonal to the rotational axis line; and a second end portion arranged at an opposite side to the first end portion in the orthogonal direction.

3. The developing device according to claim 2, wherein the first frame is provided with a gripping part at a middle part of the second end portion in the direction of the rotational axis line.

4. The developing device according to claim 1, wherein the second distance is constant over the rib.

5. The developing device according to claim 1, wherein the second distance is 100 to 300% of a minimum of the first distance.

6. The developing device according to claim 5, wherein the second distance is 140% of the minimum of the first distance.

7. The developing device according to claim 1, wherein a thickness of the agitation film is 0.50 mm or greater.

8. The developing device according to claim 1, wherein a free end portion of the agitation member does not contact the housing where the developing device is in a shipping state.

9. The developing device according to claim 8, wherein the housing comprises:

a developing chamber configured to accommodate therein a developing roller;

a developer accommodation chamber configured to accommodate therein the agitation member; and an opening configured to cause the developing chamber and the developer accommodation chamber to communicate with each other, and wherein the free end portion is arranged in the opening where the developing device is in the shipping state.

10. The developing device according to claim 1, wherein the second contact part comprises a plurality of ribs arranged in the direction of the rotational axis line.

11. The developing device according to claim 1, wherein when assuming a first virtual line connecting the rotational axis line and the first end and a second virtual line connecting the rotational axis line and a downstream end portion of the second contact part with respect to the tip end, as seen from the direction of the rotational axis line, an angle between the first virtual line and the second virtual line is 10° to 90°.

12. The developing device according to claim 1, wherein an angle between the first and second frames at a welded part of the first and second frames is 60° to 120°.

13. The developing device according to claim 1, wherein the housing comprises:

a developing chamber configured to accommodate therein a developing roller;

a developer accommodation chamber configured to accommodate therein the agitation member; and an opening configured to cause the developing chamber and the developer accommodation chamber to communicate with each other, and the opening, the first contact part, the rib and the first frame are arranged in this order in the rotating direction.

14. The developing device according to claim 1, wherein the distance from the rotational axis line to an inner surface of the rib is equal to a maximum distance from the rotational axis line to the arc surface of the first contact part.

15. The developing device according to claim 14, wherein the distance from the rotational axis line to any part of the inner surface of the rib is constant.

16. The developing device according to claim 1, wherein the agitation film contacts the first frame and the second frame when the agitation film rotates.

17. The developing device according to claim 1, wherein the first frame includes a pair of side walls configured to support opposite end portions of the agitation member.

* * * * *